United States Patent [19]

Nakajima et al.

[11] 4,086,801

[45] May 2, 1978

[54] H-SHAPE METALLIC MATERIAL ROLLING PROCESS

[75] Inventors: Koe Nakajima, Nakama; Kazuo Watanabe; Hideki Tokita, both of Kitakyushu, all of Japan

[73] Assignee: Nippon Steel Corporation, Tokyo, Japan

[21] Appl. No.: 782,821

[22] Filed: Mar. 30, 1977

[30] Foreign Application Priority Data

Mar. 31, 1976 Japan ..... 51-34305

[51] Int. Cl.[2] ..... B21B 1/12

[52] U.S. Cl. ..... 72/234; 72/225; 72/250

[58] Field of Search ..... 72/234, 225, 366, 250

[56] References Cited

U.S. PATENT DOCUMENTS

| | | | |
|---|---|---|---|
| 499,651 | 6/1893 | Butz | 72/225 |
| 723,834 | 3/1903 | Cooper | 72/245 X |
| 3,165,948 | 1/1965 | Kishikawa | 72/225 |
| 3,597,954 | 8/1971 | Nakajima et al. | 72/225 |

*Primary Examiner*—Milton S. Mehr

*Attorney, Agent, or Firm*—Wenderoth, Lind & Ponack

[57] ABSTRACT

A process for hot rolling an H-shaped metallic material from a workpiece of rectangular cross section which comprises reducing the workpiece in the width direction thereof while wedgewise knifing the opposing sides of the workpiece by means of a first pair of grooves formed in rolls of a vertical roll stand; reducing the workpiece in the width direction thereof while spreading the knifed sides by means of a second pair of grooves which may be formed in rolls of another vertical roll stand or in the rolls having said first pair of grooves; and subsequently rolling the workpiece to a required size by universal rolling mills. This process thus enables a starting material of a rectangular cross section to be employed instead of that of H-shaped cross section.

4 Claims, 19 Drawing Figures

H-SHAPE METALLIC MATERIAL ROLLING PROCESS

BACKGROUND OF THE INVENTION

This invention relates in general to a process for rolling H-shaped metallic materials, and more particularly to a hot rolling process which allows efficient production of H-shaped metallic materials from starting materials of rectangular cross section.

The following describes the present invention in conjunction with the rolling of steel as a typical metallic material, so that the finished product will be referred to as H-shaped steel or an H-beam and the starting material, as a steel slab, bloom, billet or the like, as required. It is also to be noted that the H-shaped steel herein involves not only ordinary H-shapes but also other H-shapes similar thereto.

In the rolling of H-shapes which are relatively large in cross-sectional area and over 100 mm in flange width, it has so far been a common practice that a beam blank having a configuration resembling the shape of the H-beam to be produced is used as starting material and is rolled into the intended H-shape by a two-high roughing rolling mill and a plurality of universal rolling mills. FIG. 1 illustrates the cross-sectional shape of an exemplary beam blank 1 employed in the prior art. FIG. 2 shows an exemplary rolling system layout according to the prior art. In this arrangement, a two-high roughing rolling mill 11 is followed by universal rolling mills 12, 13 and 14, and edging mills 15 and 16 are added to the universal rolling mills 12 and 13 on the respective entry sides thereof. In the rolling system shown in FIG. 2, a beam blank 1 heated to a rolling temperature and conveyed on a roller table 10 is first subjected to roughing in the roughing rolling mill 11 and then undergoes intermediate rolling and finishing rolling in the universal rolling mills 12, 13 and 14 so as to be finished to a required size. In the universal rolling mill 12 for example, the horizontal rolls 12H depress the web surfaces of the workpiece while the vertical rolls 12V depress the flange surfaces thereof. The edging mills 15 and 16 reduce the flange tips to form flanges of a desired width.

Such a rolling method, however, necessitates the use of grooved rolls in the breakdown step for beam blank production and therefore requires 90° turns of the workpiece and an increased number of times of passage of the material between rolls, with a consequent great decrease in rolling efficiency.

For the purpose of efficient rolling, therefore, it is desirable to employ a starting material of rectangular cross section in place of a beam blank.

Based on this concept, a process has already been devised for rolling a starting material of rectangular cross section in universal rolling mills from the beginning, as exemplified in FIG. 3. As shown, a rectangular cross section material 3 is rolled into an H-shaped product 7 having a web portion 8 formed by horizontal rolls 21 and flange portions 9 formed by vertical rolls 23. The horizontal rolls 21 are forcedly driven to rotate around the respective axes 22 while the vertical rolls 23 are not forcedly driven but rotate as followers around the respective axes 24 through frictional contact with the workpiece.

However, this rolling process is also beset with the following problems:

(a) This process is more advantageous in the lateral spreading of the flanges than the rolling by two-high type rolls. Nevertheless, this method also requires the starting material to have a larger thickness than the flange width of the finished product.

(b) Hence, the rolling reduction in the web portion by the horizontal rolls is so large that, as shown in FIG. 4, the web portion 8 extends at both the front and rear ends thereof to form a crop "C" at each end, thus lowering the yield.

(c) Generally, the starting material tends to have a relatively large cross-sectional area, and the material elongation to the final length tends to increase. Thus, difficulties in rolling may be encountered for reasons concerning equipment conditions.

More particularly, there is a limit to the length of the rolling line in view of the necessity of an elongated building, a sawing machine, an increased number of times of material passage between rolls, and so forth. Thus, the cross-sectional area of the starting material is limited by the length of the rolling line. Conversely, it can be considered to lessen the length of the starting material corresponding to an increase in the cross-sectional area of the starting material. In this case, however, as compared with the length of a heating furnace, the length of the material may become so short as to cause a significant decrease in the efficiency of the furnace.

SUMMARY OF THE INVENTION

This invention is effective to solve the aforementioned problems associated with the prior art, and an object of the invention is to provide a process for rolling a flat metallic workpiece into an H-shaped material finished to a required flange width.

Another object of the present invention is to provide an H-shaped metallic material rolling process which allows improved biting of the workpiece between rolls and prevention of crop formation.

Still another object of the invention is to provide a rolling method adapted for efficient production of H-shaped metallic materials by inexpensive equipment.

In order to attain these objects, this invention provides a process for the hot rolling of an H-shaped metallic material from a workpiece of a rectangular cross section, which process is characterized by reducing the workpiece in the width direction thereof while wedgewise knifing opposing sides of the workpiece by means of a first pair of grooves formed in rolls of a vertical roll stand; reducing the workpiece in the width direction thereof while spreading the knifed sides by means of a second pair of grooves which may be formed in rolls of another vertical roll stand or in the rolls having said first pair of grooves; and subsequently rolling the workpiece to a required size by universal rolling mills.

BRIEF DESCRIPTION OF THE DRAWINGS

FIGS. 13 (*a*) and (*b*) are sectional views of workpieces employed in both said prior art processes. FIG. 13 (*c*) is a sectional view of a workpiece employed in the process of the present invention, and FIG. 13(*d*) is a sectional view of the final shape to be produced from said three types of starting material.

DESCRIPTION OF THE PREFERRED EMBODIMENTS

Figure 5:
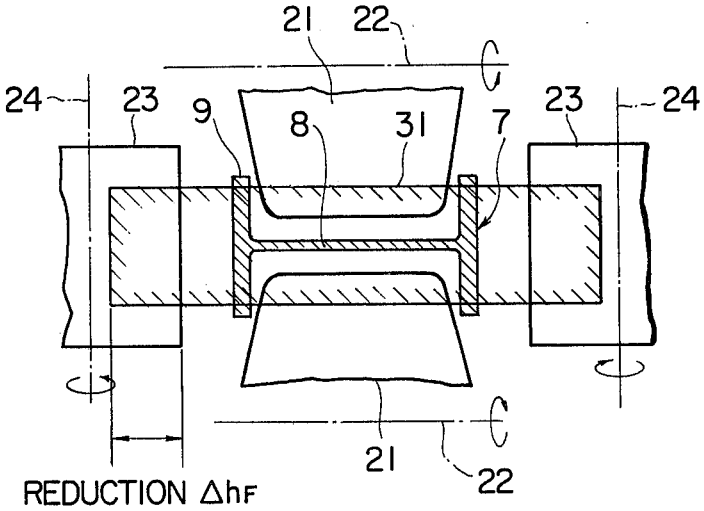
FIG. 5 is a sectional view which schematically illustrates the interrelation of rolls, a starting material and a finished product in a universal rolling process, the starting material being a relatively flat workpiece of rectangular cross section.

In the schematic view of FIG. 5, there is shown a flat starting material 31 to be subjected to universal rolling. Just like the prior art process shown in FIG. 3, this universal rolling method includes reducing the workpiece 31 by means of horizontal rolls 21 and vertical rolls 23. However, the starting material 31, unlike the material shown in FIG. 3, has a thickness smaller than the width of the flanges 9 of the final shape or product 7 and has a width much larger than the width of the web 8 of the final shape 7. The cross-sectional dimensions of the starting material are determined by those of the final shape. The initial width is always larger than the web width of the final shape, and the initial thickness is substantially equal to or smaller than the final shape.

Figure 3:
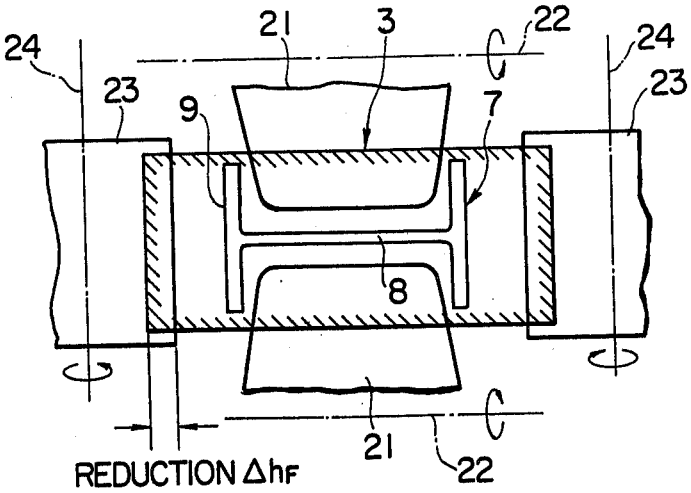
FIG. 3 PRIOR ART
FIG. 3 is a sectional view which schematically illustrates the interrelation of rolls, a starting material and a finished product in a recently devised universal rolling process, the starting material employed therein being of rectangular cross section.
Figure 4:
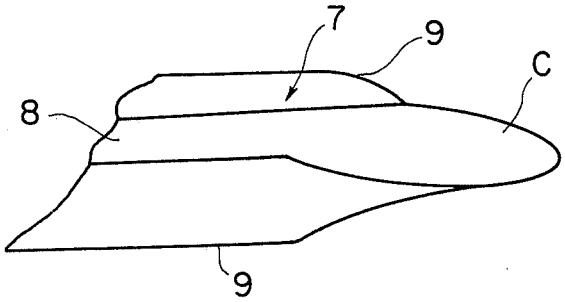
FIG. 4 PRIOR ART
FIG. 4 is a perspective view showing a typical crop formed in a product rolled by the prior art method illustrated in FIG. 3.

This process makes the rate of decrease in the thickness of the starting material higher than the rate of increase in the width thereof, thereby allowing the starting material to have a smaller cross-sectional area than that of the corresponding material employed in the method illustrated in FIG. 3 and at the same time permitting the reduction by the horizontal rolls to be smaller and the reduction ($\Delta hF$) by the vertical rolls to be larger. Hence, the elongation of the web portion is allowed to approach that of the flange portions, thus restricting crop formation.

In contrast to this advantage, the rolling of a starting material which is small in thickness into a shape with a large flange width requires a further increased extent of lateral spreading of the flanges and thus provides a more severe forming condition than in the rolling method of FIG. 3. In order to meet such a condition, it is necessary to further increase the width of the starting material and the reduction by the vertical rolls and to utilize the resultant lateral spreading for finishing to a required flange width. However, an ordinary universal rolling mill includes nondriven vertical rolls and brings the workpiece into contact with the vertical rolls earlier than with the horizontal rolls. Thus, a difficulty arises in the biting of the material between the rolls, such that the rolling with such a larger reduction by the vertical rolls is practically impossible.

Figure 1:
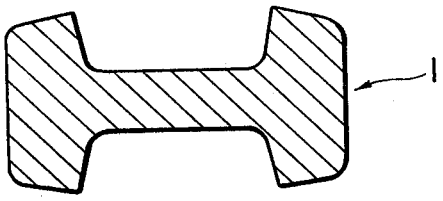
FIG. 1 PRIOR ART
FIG. 1 is a sectional view showing the configuration of an exemplary beam blank employed in the rolling of H-shaped steel according to the prior art.
Figure 2:
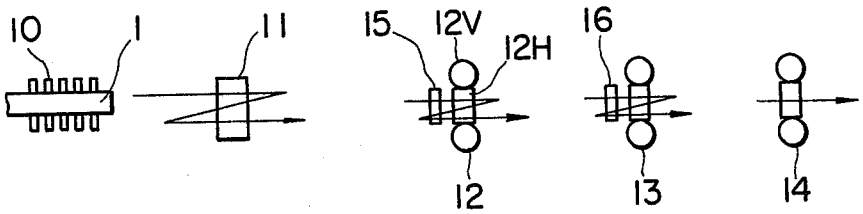
FIG. 2 PRIOR ART
FIG. 2 is a layout diagram showing an exemplary H-shaped steel rolling system associated with a conventional rolling process.
Figure 6:
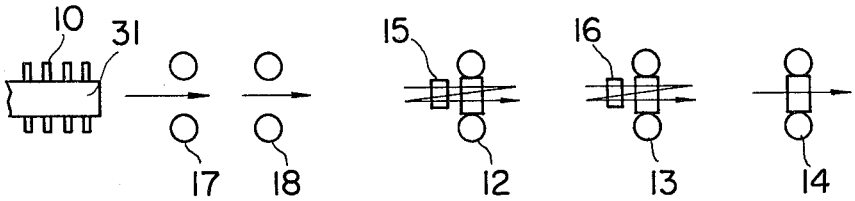
FIG. 6 is a layout diagram showing an exemplary H-shaped steel rolling system adapted to practice the rolling process of the present invention.

Accordingly, the present invention contemplates a method of partially reducing this increased material width by means of an independent rolling mill including one or two vertical roll stands. The layout of an exemplary rolling system including such an independent mill is shown in FIG. 6. In this illustrative arrangement, vertical roll stands 17 and 18 are installed on the entry side of a universal rolling mill 12 and used for preliminary positive reduction of the workpiece in the width direction thereof. The resultant metal shift in the flange width direction is utilized for sufficient lateral spreading of the flanges. Thereafter, the workpiece is rolled into a finished product in universal rolling mills 12, 13 and 14. These universal mills, with edging mills 15 and 16 added thereto, are the same as those shown in FIG. 2.

Figure 7A:
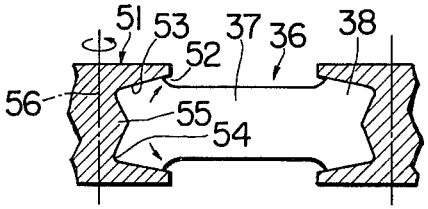
FIG. 7 is a sectional view illustrating knifing grooves and spreading grooves which are formed in the rolls of vertical roll stands in order to display the effect of the present invention and a roll arrangement in a universal stand, and also showing changes in cross-sectional configuration of a workpiece. Thus, FIG. 7(*a*) illustrates the condition where the flange portion used to spread the concave portion of the material is reduced by the rolls provided with knifing grooves, FIG. 7(*b*) shows the condition wherein the flange portion of the material is reduced by the rolls formed with spreading grooves, and FIG. 7(*c*) shows the condition wherein the web portion and flange portion of the rolled material as shown in FIG. 7(*a*) and FIG. 7(*b*) are further spread and reduced by the universal rolling stand.
Figure 7B:
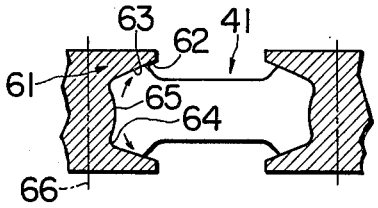
Figure 7C:
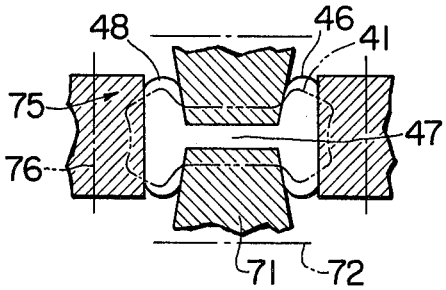

A reference is now made to the configuration of the rolls of the vertical roll stand. If flat rolls were employed, the workpiece would buckle or warp so that stable rolling could not be accomplished. For this reason, grooved rolls are arranged in the stand. Furthermore, as shown in FIG. 7, the grooves in the rolls are so formed as to have the rolling functions of "knifing" and "spreading", which are known to those in the art and are particularly effective to maximize the lateral spreading of the flanges. FIGS. 7 (*a*), (*b*) and (*c*) illustrate rolls having knifing grooves, rolls having spreading grooves, and a universal roll arrangement, respectively. The arrows represent directions of metal movement.

In FIG. 7(*a*), the groove 52 of each vertical roll 51 has opposed sides 53 inclined so that the cross section of the groove 52 lessens in width toward the bottom 54 thereof, that is, the flange portion 38 of the workpiece 36 lessens in width toward the outside. At the bottom 54 of the groove 52, there is formed a V-shaped or wedge-shaped projection 55. Both vertical rolls 51 are driven to rotate around the respective axes 56, thus reducing the workpiece 36 only in the width direction thereof. The projections 55 of the grooved rolls 51 knife the sides of the workpiece 36 or flange portions 38. The metal within each groove 52 is forced to separate at the bottom center and moves toward the upper and lower sides 53 of the groove 52 as indicated by the arrows in FIG. 7 (*a*) and thus tends to flow out of the groove. Meanwhile, the web portion 37 is not reduced.

Referring to FIG. 7 (*b*), the vertical rolls 61 shown therein are used for rolling after the use of the rolls 51 shown in FIG. 7 (*a*). Just as in the vertical rolls 51, the groove 62 formed in each vertical roll 61 has sloping sides 63 and a bottom 64 formed with a more obtuse wedge-shaped projection 65. The vertical rolls 61 are driven to rotate around the respective axes 66 and reduce the workpiece 41 in the width direction thereof. At the same time, the flange portions 42 knifed by the vertical rolls 51 are spread by the bottoms 64 of the grooves 62 formed in the vertical rolls 61. The metal within each groove 62 is forced to separate at the bottom center and moves along the upper and lower sides 63 of the groove 63 as indicated by the arrows in FIG. 7 (*b*) and thus tends to flow out of the groove.

FIG. 7 (*c*) shows the arrangement of the horizontal rolls 71 and vertical rolls 75 of an ordinary type of universal rolling mill. The horizontal rolls 71 are driven to rotate around the respective axes 72, while the vertical rolls 75 rotate as followers around the respective axes 76 through frictional contact with the workpiece 46. The universal rolling mill is adapted to roll the material 41 rolled by the vertical rolls 61 shown in FIG. 7 (*b*). The horizontal rolls 71 reduce the web portion 47 of the material 46 while the vertical rolls 75 reduce the flange portions 47.

With a view to enable these grooves to function optimally, the present inventors have ascertained by analysis of rich experimental data that the configuration requirements for the grooves to allow stable rolling and maximum flange spreading are as follows.

Figure 8:
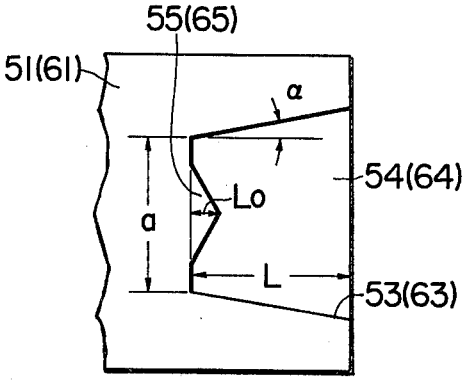
FIG. 8 is a fragmentary section of a roll used in the rolling process of the present invention, illustrating details of a groove formed therein.

Referring to FIG. 8, the knifing grooves should be under the following configuration conditions:

Groove width: $a = L$ (Thickness of starting material)

Projection height ratio: $Lo/L = 0.2$ to $0.3$

Groove gradient: $\alpha = 20$ to $30\%$

The spreading grooves should be under the following conditions:

Groove width: $a = 1.1L$ to $1.2L$

Projection height ratio: $Lo/L = 0$ to $0.2$

Groove gradient: $\alpha = 20$ to $30\%$

The more times the workpiece passes through the spreading grooves, the greater the effect. In actual practice, however, the passage operation is limited to 1 to 3 times. Under the above described conditions, the flange width can be enlarged to 1.2 to 1.5 times the thickness of the starting material.

The objects of the present invention can be fully attained by the above described process. However, in order to further heighten the effect of this invention, the present inventors have conceived of a secondary inventive idea as described below.

Figure 9:
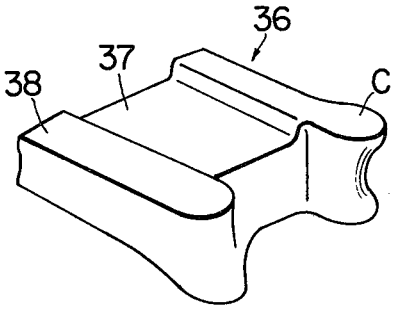
FIG. 9 is a perspective view showing crops formed in a product rolled by the process of the invention.

The rolling of a workpiece of rectangular cross section by a vertical roll stand causes the formation of so-called crops (C) at the tip of the workpiece as shown in FIG. 9, which leads to a decrease in the yield. Crop formation is due to local reducing forces applied to the workpiece only in the end areas on opposing sides of the rectangular cross section, and can be markedly lessened by applying a force to the workpiece to push in the material between the rolls of the vertical roll stand for better biting. In view of this fact, it is effective to provide a pushing device before the vertical roll stand to apply a pushing force to the workpiece from behind. Thus, in a secondary aspect of the present invention, the rolling process thereof further includes the use of such pushing means.

Figure 10:
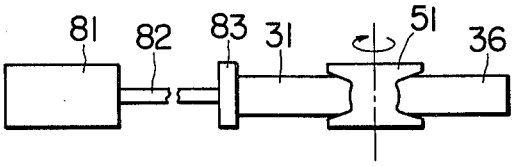
FIG. 10 is a schematic view of an exemplary pushing device adapted to force in the workpiece between rolls in the rolling process of the inventions.

FIG. 10 shows an exemplary pushing device. A fluid pressure cylinder 81 is provided with a rod 82 having a pressing head 83 fastened to the tip thereof. When the starting material 31 is to be bitten between the vertical roll 51, the material 31 is pressed at its rear end by the pressing head 83 and thus pushed in between the vertical rolls 51 to be reduced thereby. The application of the pushing force is required only when the workpiece is to be forced in between the first pair of vertical rolls 51. That is, it is not necessary to push the material inbetween the second pair of vertical rolls 61. A sufficient pushing force is such that the stress produced thereby in the workpiece is about 1 kg/mm$^2$.

The material pushing method is not limited to the use of the fluid pressure cylinder 81 but may employ pinch rolls for the same purpose.

Figure 11:
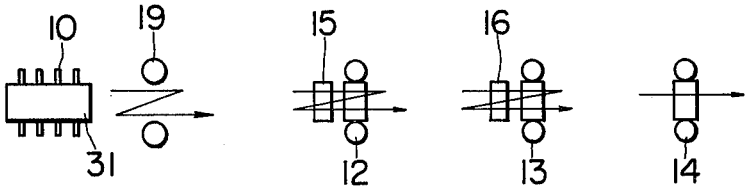
FIG. 11 is a layout diagram showing another exemplary rolling system adapted to practice the rolling process of the invention.
Figure 12:
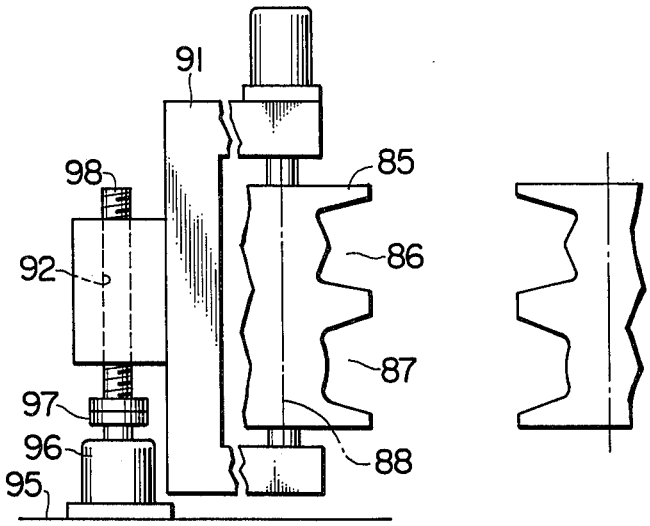
FIG. 12 is a sectional view showing modified vertical rolls to be used for practicing the process of the invention.
Figure 13A:
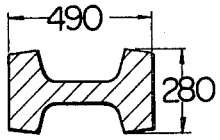
FIG. 13 illustrates the cross sections of various starting materials and a typical final shape.
Figure 13B:
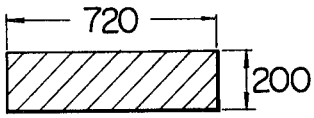
Figure 13C:
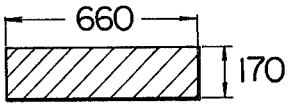
Figure 13D:
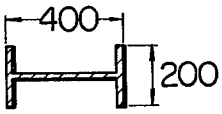

Various variations and modifications can be made in the foregoing preferred embodiments of this invention without departing from the basic concepts of the invention. By way of example, FIG. 11 shows a modified rolling system which employs a single vertical roll stand 19. As shown in FIG. 12, this stand includes vertical rolls 85 each having two grooves 86 and 87 formed therein. For each time of passage of the workpiece through the stand, the vertical rolls 85 are elevated or lowered along their respective axes 88 for groove change.

The vertical rolls 85 can be moved up and down by such elevating means as shown in FIG. 12 by way of illustration. A housing 91 supporting the roll 85 has a sidewise extending portion formed with a threaded hole 92. A motor 96 equipped with a reduction gear is firmly mounted on a floor 95, and a threaded rod 98 is coupled to the output shaft 97 of the motor 96. The threaded rod 98 is screwed in the threaded hole 92 of the housing 91 so that the rotation of the threaded rod 98 will casue the housing 91 to move up or down together with the vertical roll 85. The above described roll elevating means, which should not be taken as limitative, may be replaced by, for example, hydraulic cylinder means.

It is to be noted here that, although the use of grooved rolls in the vertical roll stand provided according to the present invention is especially effective, substantially the same effect can be achieved by employing flat rolls instead of grooved ones particularly in the vertical roll stand having the flange spreading function, in such a case as when the workpiece has a relatively small width. Such flat roll arrangement also resides within the scope of the invention.

Here follows a description of a practical example of comparison between the rolling process of this invention and the aforementioned prior art processes. The respective starting materials employed in the conventional processes were beam blanks having an H-shaped cross section of 490 mm in width and 280 mm in height and a steel slab having a rectangular cross section of 720 mm in width and 200 mm in height, as shown in FIG. 13 (*a*) and (*b*) respectively.

The starting material used in the method of this invention was a steel slab having a rectangular cross section of 660 mm in width and 170 mm in height. The sectional configuration is shown in FIG. 13 (*c*). The final product or shaped steel to be produced from each of these starting materials was H-shaped steel having a web width of 400 mm and a flange width of 200 mm. The sectional configuration of this H-beam is shown in FIG. 13 (*d*).

Figure 14:
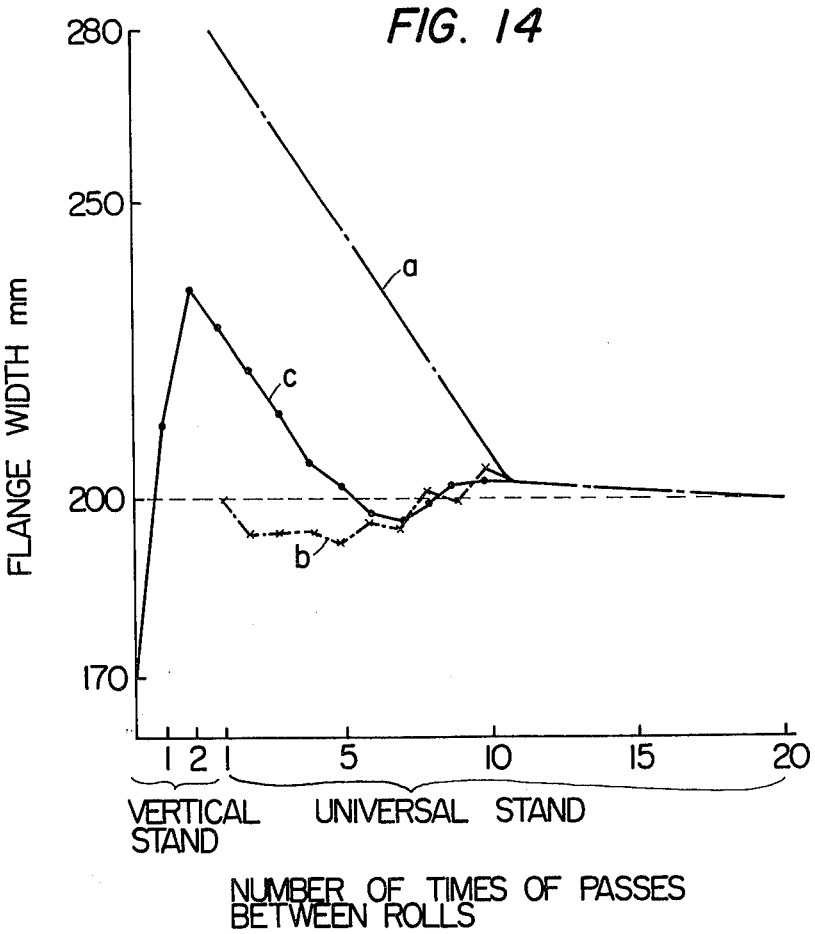
FIG. 14 is a graph depicting the relation between the number of times of material passage between rolls and flange width in the case of starting from each of the materials shown in FIGS. 13 (*a*) to (*c*).

FIG. 14 is a graph which depicts, for each of these starting materials, the relation between the number of times of material passage between rolls and the flange width. In the graph, the curves (*a*), (*b*) and (*c*) represent the changes in flange width during the rolling of the starting materials shown in FIGS. 13 (*a*), (*b*) and (*c*) respectively. The rolling of these materials was performed in the rolling system shown in FIG. 6. Referring to FIG. 14, Nos. 1 and 2 passing operations for vertical rolling were carried out in the vertical rolls stands 17 and 18, and Nos. 1 and 10 passing operations for universal rolling were carried out in the universal stand 12 shown in FIG. 6. The subsequent Nos. 11 to 20 universal rolling passage operations were performed in the succeeding universal rolling mills 13 and 14, with the result that the workpiece was finished into the final shape shown in FIG. 13 (*d*).

FIG. 14 shows that H-beams of the same size can be produced from the different starting materials of FIG. 13 (*a*). (*b*) and (*c*). Particularly, it can be seen that the process (*c*) of the present invention can produce H-shaped steel of the required flange width, 200 mm, from a material of rectangular cross section having a smaller thickness, 170 mm, than the flange width and allows a much larger extent of lateral spreading of the flanges than the prior art process (*b*) employing a starting material of rectangular cross section, thus permitting the use of a starting material which is smaller is thickness than that in the process (*b*).

It has also been found in the practical example of comparison that the starting materials of rectangular cross section employed in the processes (*b*) and (*c*) and 78% and 38% larger, respectively, in cross-sectional area than the starting material of H-shaped cross section used in the process (*a*). Further it has been found that the starting material of rectangular cross section used in the process (*c*) of the present invention is 22% smaller in cross-sectional area than that used in the prior art process (*b*).

Moreover, it has been found that, as compared with the conventional process (*b*), the present process (*c*) can provide a 50% decrease in crop length.

As apparent from the foregoing description, the present invention enables efficient production of H-shaped steel from a flat material of rectangular cross section. Furthermore, the invention can dispense with not only the conventional method of rolling H-shaped steel from beam blanks beset with a large efficiency decrease, but also the use of beam blanks manufactured by continuous casting which may pose problems concerning material quality and working efficiency, and allows the rolling of H-shaped steel from simple continuous castings of a rectangular cross section.

We claim:

1. A process for hot rolling of an H-shape metallic material from a workpiece of rectangular cross section comprising:

feeding the workpiece, with its broader sides extending horizontally, into vertical roll stand means, reducing the workpiece in the width direction thereof while wedgewise knifing the opposed sides thereof by the vertical roll stand means including rolls formed with a first pair of grooves each having a wedge-shaped projection formed at the bottom thereof to perform the function of knifing the side edge portion thereof by freeing the top and bottom surfaces corresponding to the web portion thereof from the reduction, so that the portion of the workpiece corresponding to the flange thereof is deformed by spreading the side of the wedge-shaped depressed portion thereof along the contour of the grooves, reducing the workpiece in the width direction thereof while spreading the wedge-shaped depressed side edge portion thereof by the vertical roll stand means including rolls formed with a second pair of grooves each having a wedge-shaped projection which is more obtuse than the projection formed in the first pair of grooves at the bottom to perform the function of reducing by freeing the top and bottom surfaces corresponding to the web portion of the workpiece from the reduction, so that the portion of the workpiece corresponding to the flange is deformed by spreading the side of the wedge-shaped depressed portion thereof along the contour of the grooves; and subsequently vertically reducing the web portion of the workpiece by horizontal rolls in universal rolling mills, and meanwhile transversely reducing the flange portions of the workpiece by vertical rolls in the universal rolling mills.

2. The process of claim 1, wherein said vertical roll stand means comprise at least one vertical roll stand, and the feeding of the workpiece into the first vertical roll stand comprises pushing in the workpiece between the vertical rolls.

3. The process of claim 1, wherein said workpiece has a width larger than the web width of the final shape and also has a thickness substantially equal to or smaller than the flange width of the final shape.

4. The process of claim 1, wherein said vertical roll stand means comprise a single stand including a single pair of vertical rolls each having both said first and second grooves, the vertical grooved rolls being adapted to be vertically moved along the respective roll axes for groove change so that said knifing and spreading area performed by means of the first and second grooves respectively.

* * * * *